US009512666B2

(12) United States Patent
Reyher et al.

(10) Patent No.: US 9,512,666 B2
(45) Date of Patent: Dec. 6, 2016

(54) AIR INFILTRATION REDUCTION SYSTEM, INSULATING PANEL ASSEMBLY, MOUNTING ASSEMBLY, AND METHOD OF INSTALLING THE SAME

(71) Applicant: Quanta Technologies, Inc., Malvern, PA (US)

(72) Inventors: Jay R. Reyher, Honey Brook, PA (US); Thomas D. Culp, La Crosse, WI (US); Mark M. McIntire, Lancaster, PA (US); John D. Siegel, Malvern, PA (US)

(73) Assignee: Quanta Technologies, Inc., Malvern, PA (US)

( * ) Notice: Subject to any disclaimer, the term of this patent is extended or adjusted under 35 U.S.C. 154(b) by 0 days.

(21) Appl. No.: 13/708,304

(22) Filed: Dec. 7, 2012

(65) Prior Publication Data

US 2014/0157696 A1 Jun. 12, 2014

(51) Int. Cl.

| | |
|---|---|
| ***E06B 3/26*** | (2006.01) |
| ***E06B 3/28*** | (2006.01) |
| ***E06B 3/30*** | (2006.01) |
| ***E06B 3/67*** | (2006.01) |
| ***E06B 1/36*** | (2006.01) |
| ***E06B 3/66*** | (2006.01) |
| ***E06B 7/23*** | (2006.01) |

(52) U.S. Cl.

CPC ..... *E06B 3/6715* (2013.01); *E06B 1/36* (2013.01); *E06B 3/2605* (2013.01); *E06B 3/28* (2013.01); *E06B 3/301* (2013.01); *E06B 3/66* (2013.01); *E06B 7/2309* (2013.01)

(58) Field of Classification Search

CPC ..... E06B 3/26; E06B 3/2605; E06B 3/301; E06B 3/308; E06B 5/20; E06B 5/125; E06B 5/205; E06B 3/28

USPC ..... 52/204.51, 204.593, 204.62, 2.14, 2.17,52/171.3, 172, 204.599, 204.6, 788.1, 204.5,52/202

See application file for complete search history.

(56) References Cited

U.S. PATENT DOCUMENTS

| | | | | |
|---|---|---|---|---|
| 861,573 A | | 7/1907 | Budd | |
| 1,637,959 A | | 8/1927 | Osborn | |
| 2,177,001 A | | 10/1939 | Owen | |
| 2,209,536 A | | 7/1940 | Owen | |
| 2,226,254 A | | 12/1940 | Owen | |
| 2,273,279 A | * | 2/1942 | Macklanburg | E06B 7/232 49/434 |
| 2,436,037 A | | 2/1948 | Doney | |
| 2,570,312 A | * | 10/1951 | Bond | E06B 3/44 49/444 |
| 2,617,160 A | | 11/1952 | Bodnar | |

(Continued)

*Primary Examiner* — Ryan Kwiecinski

(74) *Attorney, Agent, or Firm* — RatnerPrestia

(57) ABSTRACT

An airflow reduction system includes an insulating panel assembly for sealing a window within a jamb. The insulating panel assembly has a frame configured to fit within the jamb and a glazing panel in the frame coated with a low-emissivity or solar control coating or film. The frame may include one or more cavities extending along its length. The assembly may also include a blind stop and/or a trim stop installed on either side of the frame within the jamb. A compressible seal around the external perimeter of the frame bears against the jamb to form a first barrier impeding the flow of air, and the blind stop or the trim stop forms a second barrier impeding the flow of air. Also disclosed is a mounting assembly including an insulating panel assembly and at least one bracket and a method of installing the same.

7 Claims, 11 Drawing Sheets

(56) References Cited

U.S. PATENT DOCUMENTS 2,659,463 A 11/1953 Persson
2,848,762 A 8/1958 Peterson
3,024,881 A 3/1962 Haas
3,233,381 A 2/1966 Von Wedel
3,269,062 A * 8/1966 Mears, Jr. ..... E06B 3/44 49/428
3,296,763 A 1/1967 Curl
3,344,573 A 10/1967 Martin et al.
3,363,390 A 1/1968 Crane et al.
3,455,080 A 7/1969 Meadows
3,824,753 A 7/1974 Anderson
3,948,308 A 4/1976 Facey
3,971,178 A 7/1976 Mazzoni et al.
3,991,806 A 11/1976 Abell
4,021,980 A 5/1977 Wilfong
4,040,210 A 8/1977 Land
4,044,813 A 8/1977 Emmons
D247,047 S 1/1978 Damiana
4,069,641 A 1/1978 DeZutter
4,074,480 A 2/1978 Burton
4,079,558 A 3/1978 Gorham
4,089,143 A 5/1978 La Pietra
4,098,035 A 7/1978 Bessler
4,121,379 A 10/1978 Everson
4,121,394 A 10/1978 Brooks
4,137,671 A 2/1979 Miller
4,160,348 A * 7/1979 Chapman ..... E06B 1/64 160/354
4,186,522 A 2/1980 Hooks
4,194,331 A 3/1980 Gingle et al.
4,199,900 A 4/1980 Johnston et al.
4,203,256 A 5/1980 Mowry
4,208,849 A 6/1980 Lamb
4,210,191 A 7/1980 Li
4,222,200 A 9/1980 Beirnes
4,223,481 A * 9/1980 Page ..... E06B 3/2605 49/63
D258,766 S 3/1981 Gold
4,255,907 A 3/1981 Lightell
4,261,410 A 4/1981 Standiford
4,265,052 A 5/1981 Johnson et al.
4,266,594 A 5/1981 Gunn
4,274,468 A 6/1981 McPhail
4,282,919 A 8/1981 Teno
4,318,255 A 3/1982 Long
4,341,255 A 7/1982 Mock
4,357,187 A 11/1982 Stanley et al.
4,368,594 A 1/1983 Milam et al.
4,372,082 A 2/1983 Pagel
4,380,140 A * 4/1983 Abbott ..... E06B 3/285 160/395
4,439,964 A 4/1984 Chu
4,452,020 A 6/1984 Werner
4,461,119 A 7/1984 Smith
4,482,178 A 11/1984 Damiana
4,494,342 A 1/1985 Decker
4,499,703 A 2/1985 Rundo
4,514,465 A 4/1985 Schoenberg
4,547,995 A * 10/1985 Tippmann ..... E05D 15/165 49/457
4,590,124 A 5/1986 Schoenberg
4,599,825 A 7/1986 Sixsmith
4,599,836 A * 7/1986 Melcher ..... E06B 5/003 49/62
4,630,411 A * 12/1986 Salzer ..... E06B 3/2605 109/27
4,648,221 A * 3/1987 Haggqvist ..... E06B 3/28 52/202
4,656,778 A 4/1987 Fiorenza, Sr.
4,676,024 A 6/1987 Rossman
4,686,792 A 8/1987 Terrian
RE32,509 E 9/1987 Werner
4,706,729 A 11/1987 Sixsmith
4,781,235 A 11/1988 Hedstrom et al.
4,825,609 A 5/1989 Rundo
4,972,896 A 11/1990 Roberts
5,253,457 A 10/1993 Orth
5,321,911 A 6/1994 Dickinson
5,390,454 A * 2/1995 Coddens ..... E06B 3/28 160/107
5,709,055 A 1/1998 Levi
5,737,885 A * 4/1998 Stoyke ..... E06B 3/28 52/202
5,911,660 A 6/1999 Watson
5,950,398 A 9/1999 Hubbard
6,363,669 B1 * 4/2002 Hoffman ..... E06B 5/12 52/202
6,564,517 B1 5/2003 Hanssen
D542,935 S 5/2007 Tedford
7,237,365 B1 7/2007 Phandanouvong
7,278,241 B2 * 10/2007 Wirawan ..... E06B 1/36 52/203
7,763,334 B2 * 7/2010 Berkowitz ..... E06B 3/5418 428/34
8,550,140 B2 * 10/2013 Kelley ..... 160/90
8,966,839 B2 * 3/2015 Rebman ..... E06B 3/28 52/202
2011/0047875 A1 * 3/2011 Kelley ..... E06B 3/28 49/63
2011/0120031 A1 * 5/2011 Scherba ..... E04C 2/543 52/202
2012/0317910 A1 * 12/2012 Esposito ..... E06B 1/16 52/302.3

* cited by examiner

AIR INFILTRATION REDUCTION SYSTEM, INSULATING PANEL ASSEMBLY, MOUNTING ASSEMBLY, AND METHOD OF INSTALLING THE SAME

FIELD OF THE INVENTION

The present invention relates to the insulation and air sealing of primary windows using an interior insulating glass assembly.

BACKGROUND OF THE INVENTION

A substantial portion of costs associated with the maintenance of commercial and residential buildings is attributable to energy consumption, including heating and cooling. Windows are the single largest point source of energy loss in a building envelope. Many U.S. buildings do not possess energy efficient windows that meet current standards and, generally, the only practical means to address these energy losses was to replace the existing windows with modern replacement windows such as 2 or 3-pane systems that can reduce energy losses through the window units. Commercially available "high performance" replacement windows, if installed correctly, can deliver substantial improvements in energy savings if replacing either a single pane or double pane window.

However, full window replacement is costly due to the high cost of the new window, installation and disposal fees, site preparation and finishing, and possible remediation (all buildings constructed before 1978 pose the risk of exposing occupants to lead contamination when the building envelope is disrupted). Hence, due to these high costs, full window replacement is rarely, if ever, economically justified solely on the basis of energy savings or consequent improvements in occupant comfort. For this reason, traditional weatherization efforts, despite recognizing the energy loss associated with a building's windows, have elected not to address window energy losses beyond minimal caulking and weatherstripping, despite their substantially adverse impact on building operating costs, occupant comfort, and environmental considerations.

Weatherization programs that measure before and after energy consumption have historically shown a rather consistent pattern where 10-30 percent of the homes which are weatherized show no improvement in energy consumption, and in some cases, an increase in energy consumption after being weatherized. While the specific causes of this phenomena are not fully understood, it does account for a decrease in the overall cost effectiveness of building weatherization. There is some empirical evidence suggesting that windows, which are known to be a source of occupant discomfort due to mean radiant temperature effects and natural convection drafts, if not properly addressed as an element of a weatherization project, may be the cause of the problem as each of these window-related consequences would cause a home owner to adjust the interior room temperature (calling for increased heat) seeking to offset the discomfort associated with poor window performance.

For at least these reasons, there remains a need for improved window systems that can reduce energy consumption and enhance occupant comfort in commercial and residential buildings.

SUMMARY OF THE INVENTION

In accordance with one embodiment of the present invention, there is provided an insulating panel assembly for sealing a window within a jamb having an interior side and an exterior side. As used herein, "jamb" means the sill or framing around a primary window. The insulating panel assembly comprises a frame for a glazing panel that minimizes conductive and radiant energy losses. The frame is configured to fit within the jamb, and the frame has an external perimeter, an internal perimeter, and at least one frame portion defining at least one cavity extending along its length. The cavity is located between the internal perimeter of the frame and the external perimeter of the frame and is enclosed to prevent the passage of air between the external perimeter of the frame and the internal perimeter of the frame. In an installed condition, the frame reduces airflow in the exterior and interior direction around the frame.

In accordance with another embodiment of the present invention, there is provided an insulating panel assembly that comprises a frame for a glazing panel that minimizes conductive and radiant energy losses. The frame has an external perimeter surface, an exterior surface facing the interior side of the window, and an interior surface in opposing relationship to the exterior surface. The assembly further comprises at least one of a blind stop configured to directly or indirectly contact the exterior surface of the frame and a trim stop configured to directly or indirectly contact the interior surface of the frame and a compressible seal extending outwardly from the external perimeter surface of the frame. In an installed condition, the blind stop is coupled to the jamb between the frame and the window and the exterior surface of the frame directly or indirectly contacts the blind stop, or the trim stop is coupled to the jamb such that the frame is between the trim stop and the window and the interior surface of the frame directly or indirectly contacts the trim stop. The frame bears the compressible seal against the jamb on the interior side of the window forming a first barrier impeding the flow of air between the exterior surface and the interior surface of the frame, and the blind stop or the trim stop forms a second barrier impeding the flow of air between the exterior surface and the interior surface of the frame resulting in reduced air flow in the interior and exterior direction. The first and second barriers together define an insulating chamber with the external perimeter surface of the frame and the jamb.

In accordance with another embodiment of the present invention, there is provided a mounting assembly for sealing a window within a jamb having an interior side and an exterior side. The mounting assembly comprises a frame for a glazing panel that minimizes conductive and radiant energy losses. The frame has an external perimeter surface, an exterior surface facing the interior side of the window, and an interior surface in opposing relationship to the exterior surface, the external perimeter surface being free of apertures for mounting the frame to the jamb. The mounting assembly further comprises a compressible seal extending outwardly from the external perimeter surface of the frame and a bracket having a mounting portion and at least one of a front portion configured to engage the interior surface of the frame and a rear portion configured to engage the exterior surface of the frame. In an installed condition, the frame bears the compressible seal against the jamb on the interior side of the window and the compressible seal impedes the transmission of air between the exterior surface and the interior surface of the frame. The mounting portion of the bracket is fastened to the jamb and the front portion or rear portion of the bracket limits movement of the frame within the jamb.

In accordance with yet another embodiment of the present invention, there is provided a method of installing a mounting assembly within a jamb for sealing a window having an interior side and an exterior side. The method comprises attaching a bracket to the jamb, the bracket having a mounting portion and at least one of a front portion configured to engage the interior surface of the frame and a rear portion configured to engage the exterior surface of the frame; inserting a frame within the jamb and adjacent to the bracket such that the frame bears a compressible seal against the jamb and the compressible seal impedes the flow of air between the exterior surface and the interior surface of the frame; and engaging the front portion of the bracket with an interior surface of the frame or the rear portion of the bracket with an exterior surface of the frame to limit movement of the frame within the jamb, thus eliminating the need for apertures in the frame for mounting the frame to the jamb.

In accordance with yet another embodiment of the present invention, there is provided an airflow reduction system for sealing a window within a jamb having an interior side and an exterior side. The airflow reduction system comprises a frame for a glazing panel that minimizes conductive and radiant energy losses. The frame has an external perimeter surface and a compressible seal extending from at least a portion of the external perimeter surface of the frame. In an installed condition, the frame bears the compressible seal against the jamb on the interior side of the window, and the airflow reduction system provides a first air infiltration and exfiltration rate between the exterior surface and the interior surface of the frame that is less than a second air infiltration and exfiltration rate between the exterior surface and the interior surface of the window.

In accordance with an alternative embodiment of the airflow reduction system, the assembly comprises a frame for a glazing panel that minimizes conductive and radiant energy losses and at least one of a blind stop and a trim stop. In an installed condition, the blind stop is attached to the jamb between the frame and the window, and a rear barrier is formed between the blind stop and the frame to impede the flow of air between the exterior surface and the interior surface of the frame; or the trim stop is attached to the jamb such that the frame is between the trim stop and the window, and a front barrier is formed between the trim stop and the frame to impede the flow of air between the exterior surface and the interior surface of the frame.

BRIEF DESCRIPTION OF THE DRAWINGS

Other aspects and advantages of the invention will be apparent from the following detailed description wherein reference is made to the accompanying drawings. In order that the invention may be more fully understood, the following figures are provided by way of illustration, in which.

DETAILED DESCRIPTION OF THE INVENTION

Figure 1:
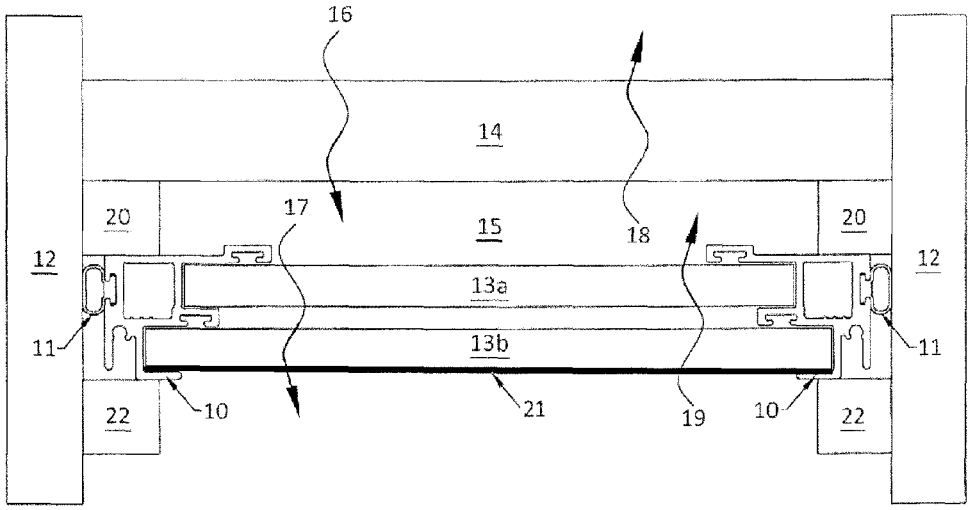
FIG. 1 is a plan view of a schematic according to an embodiment of the present invention.

Although the invention is illustrated and described herein with reference to specific embodiments, the invention is not intended to be limited to the details shown. Rather, various modifications may be made in the details within the scope and range of equivalents of the claims and without departing from the invention.

In developing improved systems for reducing the energy consumption in commercial and residential buildings that is attributable to their windows, it has been discovered that the installation of secondary panes of glass or plastic on existing windows or the installation of replacement windows to improve the energy performance may suffer from certain shortcomings either in performance, feasibility of on-site implementation, and/or the cost of the retrofit in comparison to the benefit.

For example, the application of films to existing prime windows to improve the energy performance of the prime window, while effective at managing solar heat gain, do not themselves provide the enhanced insulating performance or reduced airflow that is delivered by replacement windows. Equally important, the application of a film to a prime window typically voids the existing window's seal warranty.

Additionally, storm windows constructed with low-e glass can, subject to the design of the particular unit, deliver substantially equivalent energy savings to that delivered by high performance replacement windows by virtue of the fact that the combination of properly designed low-e glass storm windows and existing prime windows together can achieve comparable thermal properties, e.g. U-factor, SHGC, to that delivered by a state-of-the-art replacement window. In most cases, however, storm windows are not aesthetically attractive, have ineffective sealing mechanisms, and possess a limited ability to manage air flow.

Referring generally to the figures, an insulating panel assembly (101) is provided for sealing a window within a jamb (102) having an interior side (107) and an exterior side (106). The insulating panel assembly comprises a frame (100) configured to fit within the jamb (102), and the frame has an external perimeter (104), an internal perimeter (105*a*, 105*b*), and at least one frame portion (600*a*, 600*b*, 600*c*, 600*d*) defining at least one cavity (108) extending along its length. The cavity is located between the internal perimeter of the frame and the external perimeter of the frame and is enclosed to prevent the passage of air from the external perimeter of the frame to the internal perimeter of the frame. Although depicted with a square cross-section, the frame portion may have any cross-section. For example, the frame portion may have a generally U-shaped cross-section to provide a channel which receives the glazing panel. In such an embodiment, the cavity is formed after the glazing panel is installed in the frame.

In another embodiment of the invention, the insulating panel assembly includes a frame having an external perimeter surface, an exterior surface facing the interior side of the window, and an interior surface in opposing relationship to the exterior surface; at least one of a blind stop configured to directly or indirectly contact the exterior surface of the frame and a trim stop configured to directly or indirectly contact the interior surface of the frame; and a compressible seal extending outwardly from the external perimeter surface of the frame. In an installed condition, the blind stop is coupled to the jamb between the frame and the window and the exterior surface of the frame directly or indirectly contacts the blind stop, or the trim stop is coupled to the jamb such that the frame is between the trim stop and the window and the interior surface of the frame directly or indirectly contacts the trim stop. The frame bears the compressible seal against the jamb on the interior side of the window forming a first barrier impeding the flow of air between the exterior surface and the interior surface of the frame, and the blind stop or the trim stop forms a second barrier impeding the flow of air between the exterior surface and the interior surface of the frame. The first and second barriers together define an air sealing chamber with the external perimeter surface of the frame and the jamb.

A mounting assembly for sealing a window within a jamb having an interior side and an exterior side is also provided. The mounting assembly comprises a frame having an external perimeter surface, an exterior surface facing the interior side of the window, and an interior surface in opposing relationship to the exterior surface, the external perimeter surface being free of apertures for mounting the frame to the jamb; a compressible seal extending outwardly from the external perimeter surface of the frame; and a bracket having a mounting portion and at least one of a front portion configured to engage the interior surface of the frame and a rear portion configured to engage the exterior surface of the frame. In an installed condition, the frame bears the compressible seal against the jamb on the interior side of the window and the compressible seal impedes the transmission of air between the exterior surface and the interior surface of the frame. The mounting portion of the bracket is fastened to the jamb and the front portion or rear portion of the bracket limits movement of the frame within the jamb.

A method is provided for installing a mounting assembly within a jamb for sealing a window having an interior side and an exterior side. The method comprises attaching a bracket to the jamb, the bracket having a mounting portion and at least one of a front portion configured to engage the interior surface of the frame and a rear portion configured to engage the exterior surface of the frame; inserting a frame within the jamb and adjacent to the bracket such that the frame bears a compressible seal against the jamb and the compressible seal impedes the flow of air between the exterior surface and the interior surface of the frame; and engaging the front portion of the bracket with an interior surface of the frame or the rear portion of the bracket with an exterior surface of the frame to limit movement of the frame within the jamb, thus eliminating the need for apertures in the frame for mounting the frame to the jamb.

Also provided is an airflow reduction system for sealing a window within a jamb having an interior side and an exterior side. It includes a frame having an external perimeter surface and a compressible seal extending from at least a portion of the external perimeter surface of the frame. In an installed condition, the frame bears the compressible seal against the jamb on the interior side of the window, and the airflow reduction system provides a first air infiltration and exfiltration rate between the exterior surface and the interior surface of the frame that is less than a second air infiltration and exfiltration rate between the exterior surface and the interior surface of the window.

Air infiltration rates can be measured using methods known by those with skill in the art. A standard method used for various fenestration products to measure air infiltration at elevated static test pressures is prescribed by ASTM E 283, which is used to determine air infiltration independent of the prime window to which the unit would be installed and is reported in cfm/ft$^2$ of glass area. An alternative method in use is a modified blower door test which measures the Effective Leakage Area (ELA) of an existing window and the degree of improvement that can be attained by performance enhancement measures such as installation of an airflow reduction system. In this method, the room is either depressurized or pressurized via a blower door apparatus, the window to be tested is isolated, and the air flow is measured passing from the exterior through the existing window into the room, or vice versa. This methodology allows for before and after treatment data. The ELA, which is reported in square inches, can be correlated to infiltration by comparing pressure differentials that typically exist between the exterior and interior of the building.

Referring now specifically to FIG. 1, a schematic top view of an embodiment of the present invention is illustrated. An airflow reduction system comprises an insulating panel assembly mounted within a window jamb (12) on the interior side of an existing primary window (14). The insulating panel assembly includes a frame (10), a compressible seal (11), and one or more panels (13*a*, 13*b*). These panels may be glass, plastic, laminated glass composites, or other materials. The primary window is a window in a structure, such as a home or commercial building, in which hot or cold air may be able to travel across and around the primary window in either the interior direction (16) or the exterior direction (18). In order to improve the energy efficiency of the area around the primary window (14), the insulating panel assembly encloses a pocket of air (15) to provide an air sealing and insulating barrier.

The embodiment illustrated in FIG. 1 includes a layer (21) on the interior side of the panel 13*b*, such as a coating, film, interlayer, or tint. The panels (13*a*, 13*b*) within the frame (10) may include one or more coatings on the interior and/or exterior surface of at least one of the panels. Low emissivity or low-e coatings are used to improve energy efficiency by reducing radiant heat loss through the window. An advantage of the present invention is that when sunlight passes through the primary window (14), the coatings on the panel assist with trapping the energy and heat the pocket of air (15) such that the temperature and pressure of the enclosed pocket of air (15) is slightly greater than either the exterior or interior of the structure in which the primary window (14) is installed. Different coatings (and also different tinted glasses, laminate interlayers, or films either alone or in combination) will exhibit this effect to a greater or lesser degree depending upon the properties such as solar absorption, solar reflection, and emissivity. The increased pressure inhibits air infiltration from the interior and exterior of the structure and will promote the purging or expulsion of air, primarily through the primary window to the exterior which should have a poorer seal than the insulating panel assembly, thereby improving the efficiency of the window by reducing the transmission of air in the interior direction or exterior direction across the insulating panel assembly. At sun down, the glass panel no longer absorbs solar energy and is allowed to cool, thereby cooling the enclosed pocket of air resulting in equalization with the exterior side of the primary window.

The cycling of daylight and night time creates a pressurization cycle and the coating on the panel increases the amplitude of the temperature fluctuations to provide a purging or refreshing of the air within the enclosed pocket between the primary window and the frame, but with the purging predominantly to the exterior through the poorer seal of the window and minimal airflow across the insulating panel assembly to or from the interior of the building. The flow of air in and out of the enclosed pocket prevents the accumulation of moisture and eliminates the need to achieve a hermetic seal around the frame and the primary window.

More specifically, during the daytime in the summer season, when the window and insulating panel assembly are exposed to the sun (primarily direct solar exposure, but also indirect solar exposure), increasing pressure in the pocket of air creates back pressure to prevent hot, humid outside air from entering through existing primary window and causes some air within the pocket to exit to outside. At nighttime during the summer season, reduced pressure within the air pocket results from decreasing outdoor temperatures, enabling the pocket to receive fresh air to equilibrate. However, outside air temperatures typically decrease faster than the air pocket's temperature, so the pocket pressure remains slightly higher to neutral as compared to the pressure outside. Under solar exposure during the daytime in the winter season, the air pocket's pressure again increases, preventing cold outside air from entering through the existing primary window and causes some air within the pocket to exit to the outside. At nighttime during the winter season, similar to the summer season, the air pocket's pressure decreases as a result of either decreasing outdoor temperature or near constant outdoor temperature and no heat generation in the air pocket, enabling the air pocket to receive fresh air to equilibrate. The entry of cold, dry winter air does not create a moisture or condensation problem because of its low humidity content. The system is designed to allow for minimal air exchange which occurs predominantly between the pocket and the outside, and to a much lesser degree through the insulating panel assembly to or from the inside of the building. As previously discussed, the coatings on the panels (or also tinted glasses, laminate interlayers, or films either alone or in combination) magnify the amplitude of temperature fluctuations in the air pocket by absorbing radiation in the solar spectrum during the daytime such that the pressure differential between the air pocket and the outside causes a periodic change of atmosphere within the pocket, thereby reducing the likelihood of accumulated moisture in the pocket or condensation as a result thereof.

In addition to a compressible seal (11) extending from at least a portion of the external perimeter surface of the frame (10), the insulating panel assembly may also include at least one of a blind stop (20) and a trim stop (22). In an installed condition, the frame (10) may bear the compressible seal (11) against the jamb (12) on the interior side of the primary window (14). Alternatively, the blind stop (20) may be attached to the jamb (12) between the frame (10) and the primary window (14) to form a rear barrier between the blind stop (20) and the frame (10) to impede the flow of air (17, 19) between the exterior surface and the interior surface of the frame (10); or the trim stop (22) may be attached to the jamb (12) such that the frame (10) is between the trim stop (22) and the primary window (14), and a front barrier is formed between the trim stop (22) and the frame (10) to impede the flow of air (17, 19) between the exterior surface and the interior surface of the frame (10).

For any of the embodiments described, the airflow reduction system provides a substantially reduced infiltration and exfiltration rate after installation. Preferably upon installation, the air infiltration and exfiltration rate across the overall system is controlled in such a way as to reduce energy loss while also accommodating and benefiting from changes in pressure in the space between the original window and the air infiltration reduction system as described herein.

Although the possibility of optionally creating a hermetic seal is contemplated according to this invention, it has been discovered that a limited air infiltration is surprisingly beneficial. Despite the fact that a hermetic seal may seem intuitively superior, limited air infiltration has been discovered to confer at least the following benefits. First, even with limited air infiltration, energy losses are substantially reduced as compared to those associated with the original window. Second, limited air infiltration cooperates with temperature and pressure fluctuations of the air in the space between the frame of the system and the original window; specifically, the temperature and pressure fluctuations tend to dampen the air infiltration. Also, limited air infiltration helps encourage recycling of the air in the space between the frame of the system and the original window in such a way that reduces the accumulation of moisture.

Figure 2B:
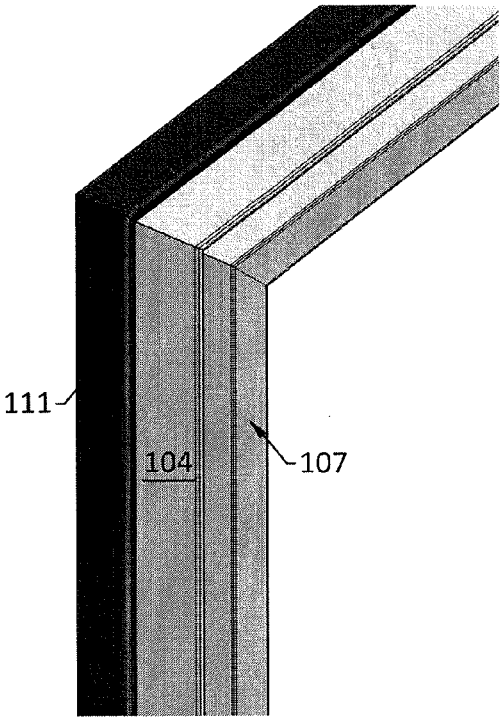
FIG. 2*b* is a perspective view of a corner of the insulating panel assembly illustrated in FIG. 2*a;*
Figure 2A:
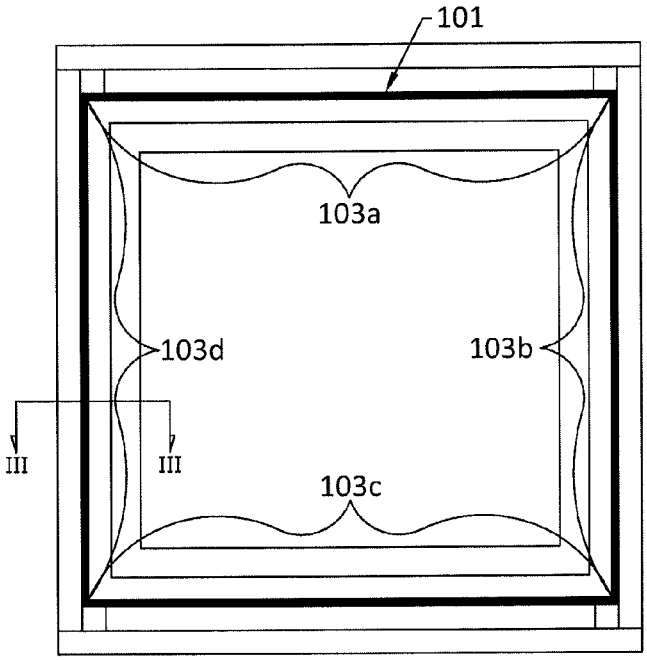
FIG. 2*a* is front view of an insulating panel assembly in an installed condition according to another embodiment of the present invention.
Figure 3:
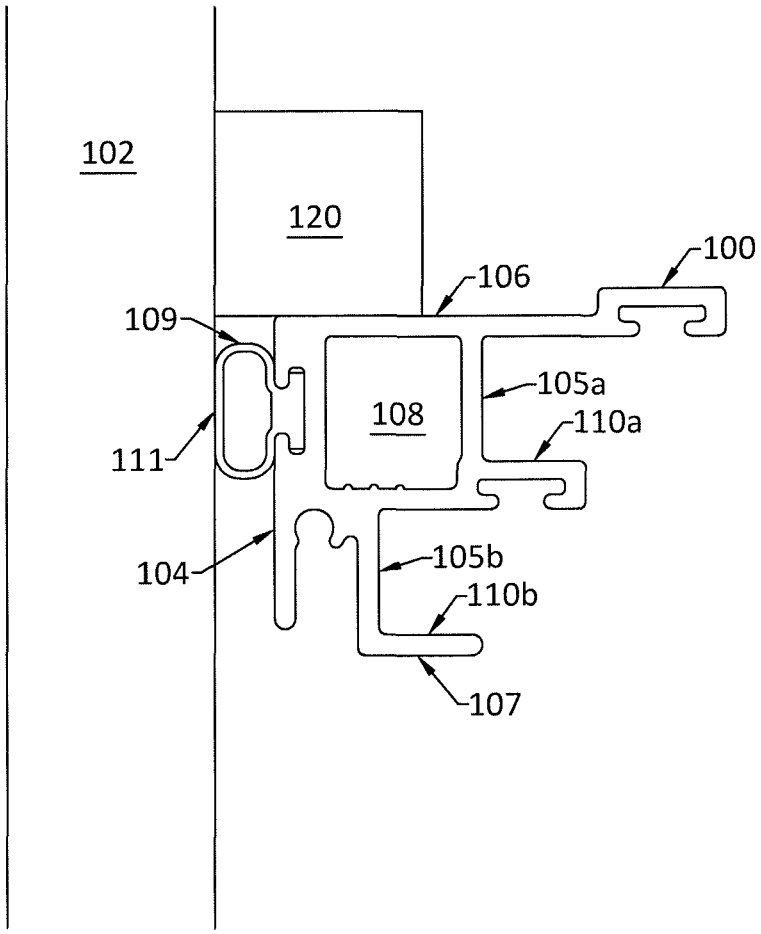
FIG. 3 is a cross-sectional view of the insulating panel assembly illustrated in FIG. 2*a* along line III-III.

In FIG. 3, a cross-sectional view of an insulating panel assembly of another embodiment of the present invention is illustrated. The cross-sectional view is provided along axis as provided in the front view of the installed insulating panel assembly in FIG. 2*a*. The insulating panel assembly comprises a frame (100) configured to fit within the jamb (102) against a blind stop (120). The frame may be made of any material known by those of skill in the art, e.g. wood, vinyl, fiberglass, or aluminum. The frame is preferably fabricated from Aluminum Alloy 6603 that is T-5 tempered and coated with a durable, highly weatherable coating, the coating preferably being a polyester, siliconized polyester, or polyvinylidene fluoride based paint system applied by either solvent or electrostatic air spray or powder coating.

Figure 10A:
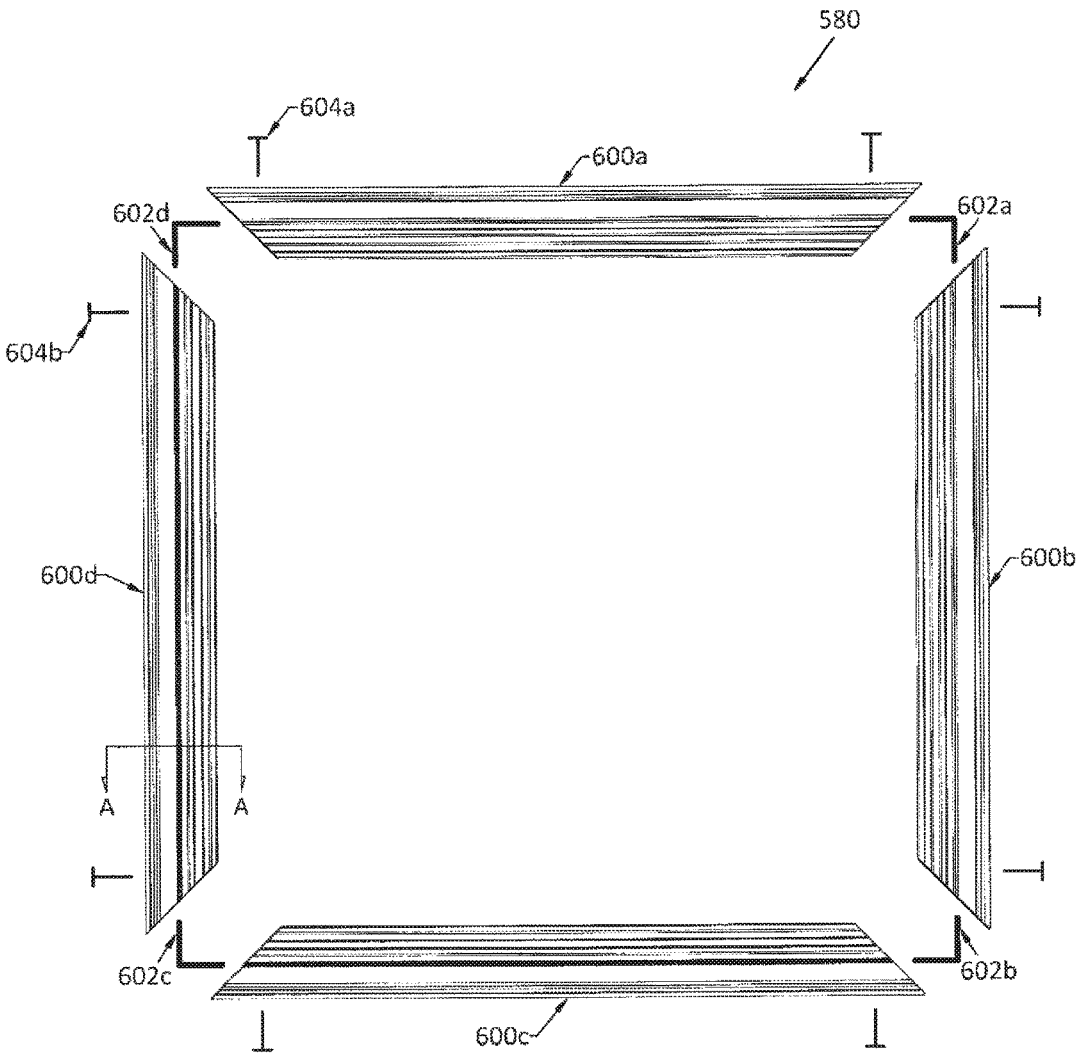
FIG. 10*a* is front view of an insulating panel assembly according to yet another embodiment of the present invention.
Figure 10B:
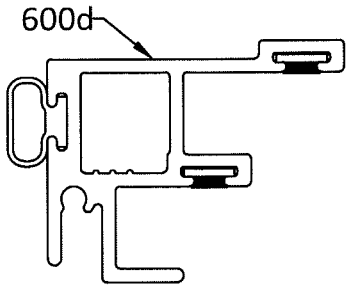
FIG. 10*b* is a cross-sectional view of the insulating panel assembly illustrated in FIG. 10*a* along line A-A.
Figure 10C:
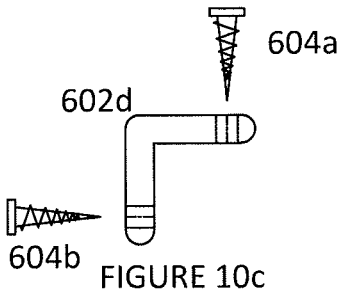
FIG. 10*c* is a plan view of one embodiment of the fastening means illustrated in FIG. 10*a*.

The frame (100) includes an external perimeter (104) from which a compressible seal (109) extends, an internal perimeter (105*a*), and one or more frame portions. While the embodiment illustrated in FIG. 2*a* is square and therefore has four frame portions (103*a*, 103*b*, 103*c*, and 103*d*), the insulating panel assembly may have any shape, (e.g. round, oval, triangular, square, etc.), such that the assembly corresponds to the shape of the window jamb in which it will be mounted. The insulating panel assembly may therefore include several coupling pieces. For example, in the embodiment illustrated in FIG. 10*a*, four coupling pieces (602*a*, 602*b*, 602*c*, and 602*d*) are located at each corner of the frame (580) to interconnect the four frame portions (600*a*, 600*b*, 600*c*, and 600*d*) into the shape of a square. Any fastening means known to those of skill in the art may be used to secure the frame portions together, such as the corner keys (602*d*) and screws (604*a*, 604*b*) of the embodiment illustrated in FIGS. 10*a* and 10*c*.

Referring again to FIG. 3, the insulating panel assembly is mounted within a window jamb (102) having an interior side (107) and an exterior side (106). At least one of the frame portions of the assembly defines one or more cavities (108) extending along the length of the frame portion, the cavities being located between an internal perimeter, such as internal perimeter (105*a*), and the external perimeter (104) of the frame (100) and enclosed to prevent the passage of air from the external perimeter (104) to an internal perimeter (105*a*, 105*b*) of the frame (100). It is preferred that the cavities are completely closed to the exterior of the frame to prevent the passage of air and moisture. The number of cavities are generally defined by the tracks (110*a*, 110*b*) of the frame (100) in which glass panels are installed.

Figure 4:
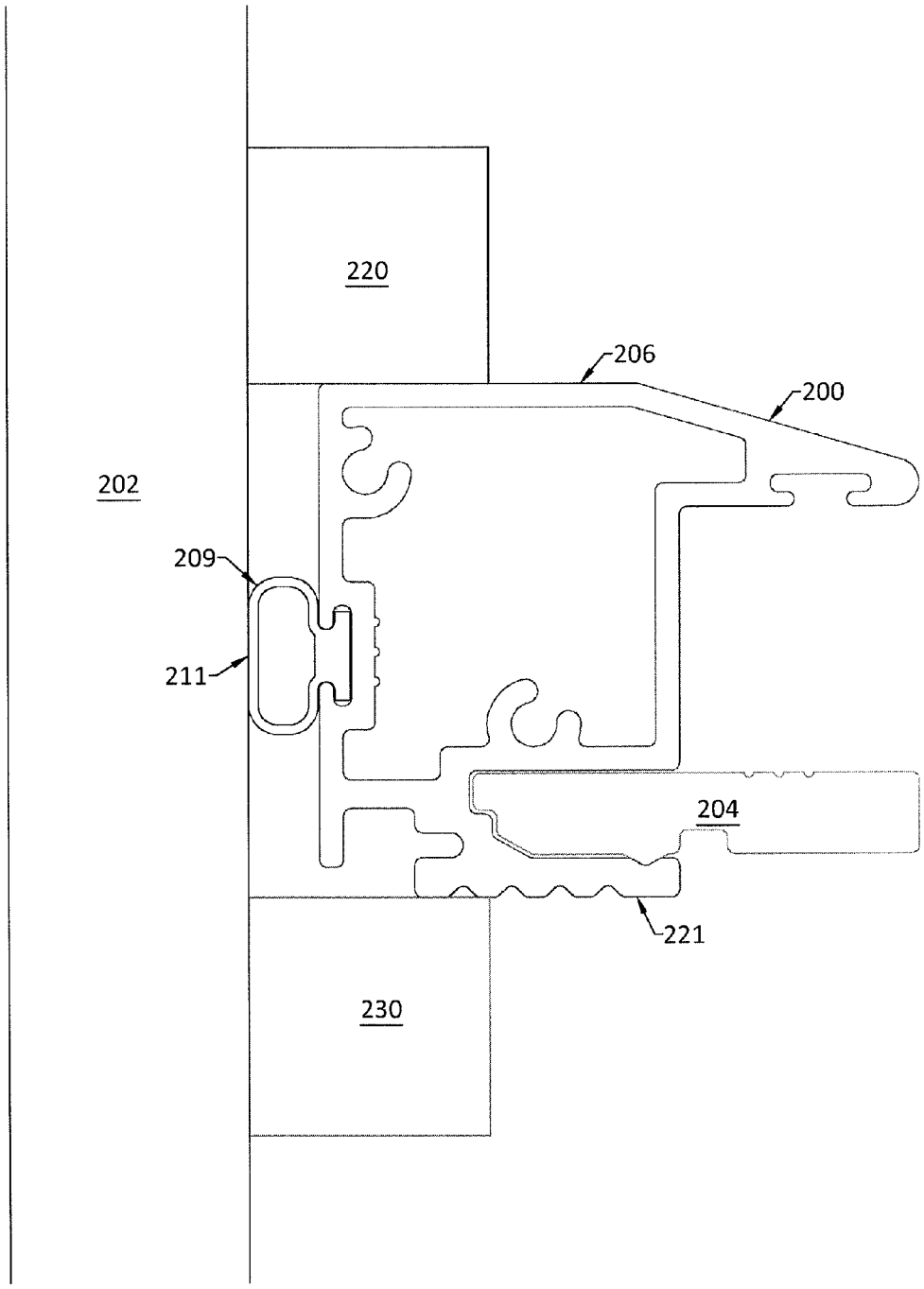
FIG. 4 is a cross-sectional view of an insulating panel assembly in an installed condition according to another embodiment of the present invention.
Figure 9:
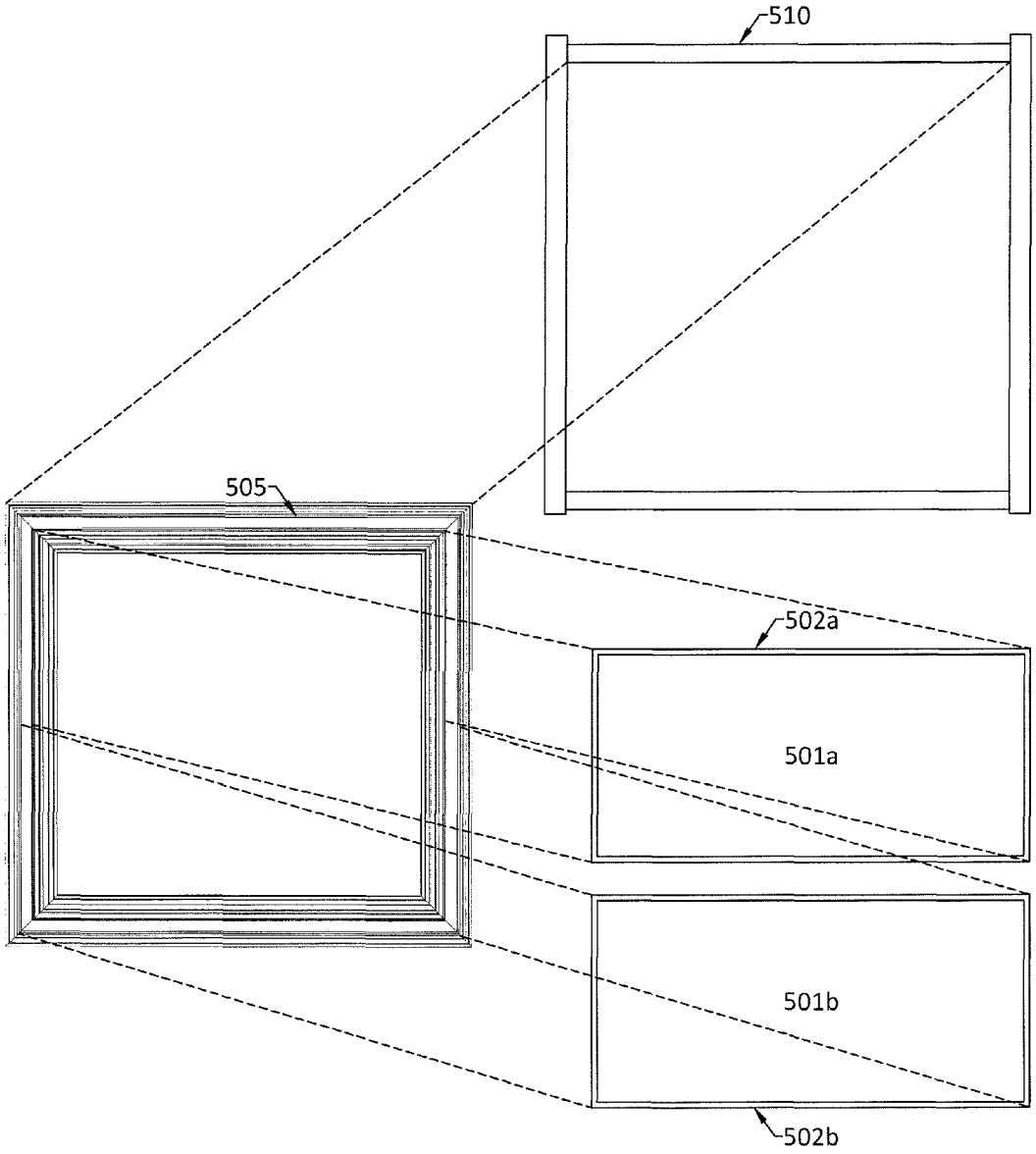
FIG. 9 is an exploded view of an insulating panel assembly in an installed condition according to another embodiment of the present invention.

The frame of the insulating glass assembly may include either a single non-operable track in which a panel is installed, as illustrated in the embodiment in FIG. 4, or multiple tracks for one or more operable panels, as illustrated in FIG. 3. Referring to FIG. 9, the panels (501*a*, 501*b*) may be each secured on all four sides within a panel frame (502*a*, 502*b*) formed of the same material as the frame (505) mounted within the jamb (510). The panel may be retained in place within the panel frame by an elastomeric glazing material and optionally an adhesive. Weather-stripping may be applied to at least one of the panel frame or the track to create a seal between the two. The panel frame should be configured, such that once inserted, the passage of air and moisture between the space where the panel frame sits within the track is substantially reduced. A removable locking bar may also be installed onto a frame having a non-operable panel, such as the locking bar (204) illustrated in the embodiment of FIG. 4.

In the embodiment illustrated in FIG. 3, the frame of the insulating glass assembly comprises a first track (110*a*) defined by an internal perimeter (105*a*) of the frame (100) in which a first panel is mounted, a second track (110*b*) also defined by an internal perimeter (105*b*) of the frame (110) in which a second panel is mounted, wherein the second panel is operable either horizontally or vertically relative to the first panel. For example, one or both panels may be able to slide or pivot at one end. The frame may include swivel keys, anti-bow pins, slots, rollers or one or more latches and latch springs designed to hold the panel within its specified track and facilitate both free movement of the panel within the designated track and securing of the panel in either the closed or open state. The insulating glass assembly may also include a third track in the frame to accommodate a mesh screen. The screen may be manufactured from painted aluminum, vinyl or vinyl coated aluminum with varying mesh, the preferred material being a painted aluminum. Like the panel, the mesh may be secured on all four sides within a mesh frame formed of the same material as the frame installed onto the jamb and may be movable to allow access to the primary window.

A durable solar control coating or film or a low-emissivity coating, is preferably applied to at least one of the interior and exterior surface of the first and/or second panel.

The properties of the coating or film or tinted glass or interlayer are selected to increase the amplitude of day/night temperature fluctuations in the space between the insulating panel assembly and the primary window such that pressure differentials between the interior and exterior sides of the frame are cyclically increased to facilitate air flow into and out from the space between the airflow reduction system and the primary window, predominantly through the poorer seal of the primary window to the exterior.

The coating or film is also selected such that it will transmit the maximum amount of visible light with a reduced emissivity as compared to an uncoated panel. In a preferred embodiment of the present invention, the coating has an emittance of less than 0.16 which provides a reduction in the transmission of long-wave radiation, known as the Far Infrared (IR), thereby achieving an IR reflection efficiency of 84%. This reduced infrared emittance (or low emissivity) compared to an uncoated panel will reduce radiant heat loss across the window and insulating panel assembly.

Additional optional coatings may be applied, such as a coating that can absorb solar infrared radiation (wavelengths in the range of 0.30 to 2.5 microns), or a coating that can absorb solar infrared and UV radiation to cause an elevation of the surface temperature of the panel to which the coating is applied. The low-emissivity coating or solar control coating or film may also be combined with tinted glass, film, or plastic layers to further increase the temperature of the panel and absorb radiation in the solar spectrum. Not only will this solar absorption enhance the day/night temperature fluctuations in the space between the insulating panel assembly and the window, but the solar absorption can be tailored for the local climate to reduce solar heat gain into the building to reduce cooling demand.

Furthermore, the insulating panel assembly may also include a compressible seal. For example, in the embodiment illustrated in FIG. 3, the insulating panel assembly comprises a compressible seal (109) extending outwardly from the external perimeter surface (104) of the frame (100). The frame (100) bears the compressible seal (109) against the jamb (102) on the interior side of the primary window forming a first barrier (111) impeding the flow of air from the exterior surface (106) to the interior surface (107) of the frame (100). The seal eliminates the need for direct attachment of the frame to the window jamb, thus, reducing points of contact and thermal conductivity between the frame and the jamb and preventing any undue stress on the frame that may result in warping.

The compressible seal is preferably made of a durable elastomeric material, preferably an ethylene-vinyl acetate copolymer, and is fabricated to allow for a pre-determined tolerance, such that the shape of the frame need not match the shape of the jamb exactly while still being capable of forming the first barrier. Furthermore, the seal allows for reasonable contraction and expansion over time without compromising the integrity of the seal. Equally important, the flexible nature of the seal will act to maintain seal integrity independent of changing ambient temperatures and conditions and the different rates of expansion and contraction with variable building materials used in the existing window jam and insulating panel assembly.

More specifically, the compressibility of the seal imparts to the insulating panel assembly the ability to fit within jambs that are not the same size as the frame or are not perfectly square by providing for forgiveness in the tolerances of the frame and imperfections in the existing jamb without having to fix or replace the existing jamb as part of on-site installation. The seal thereby provides the advantage of simplifying installation making it easier and faster to install multiple assemblies in a commercial or residential structure.

The insulating panel assembly may further comprise at least one of a blind stop (220) and a trim stop (230), as illustrated in FIG. 4. In the embodiment illustrated in FIG. 4, the compressible seal (209) bears against the window jamb (202) forming a barrier (211), the interior side (221) of the frame (200) may bear against the trim stop (230) and the exterior side (206) of the frame (200) may bear against the blind stop (220). The embodiment in FIG. 4 also includes a removable locking bar (204) installed after inserting an immovable glass panel (not shown) into the frame (200). Because the blind stop is installed between the frame and the primary window, the blind stop may be relatively hidden from view from either the exterior side of the primary window or the interior side of the frame. However, the trim stop, because it is installed on the interior side of the frame, is exposed. Therefore, it may be desirable to provide a trim stop having an aesthetically-selected surface. "Aesthetically-selected" as used herein means to select a visual property of the surface to influence the appearance of the exposed surface of the trim stop. For example, an aesthetically-selected surface may include a shape or color that complements at least one of the window, the jamb, or the molding around the window. A material, such as an adhesive or gasket, may be included between the frame and either the blind stop or the trim stop; therefore, the blind stop and trim stop are configured to either directly or indirectly contact the frame.

In an installed condition, the blind stop or the trim stop may form a second barrier impeding the flow of air between the exterior surface and the interior surface of the frame. Therefore, the first and second barriers together may define an air sealing chamber with the external perimeter surface of the frame and the jamb. Because the insulating panel assembly is intended for installation in a window jamb without removal of the primary window, it is preferred that the frame have a low profile to ensure sufficient window jamb depth is available on the interior side of the primary window for installation of the frame, blind stop, and trim stop. It may also be desirable to provide a frame having as small a frame width as possible to maximize the ratio of panel to frame for the insulating panel assembly.

According to another embodiment of the present invention, a mounting assembly is provided for sealing a window within a window jamb. The mounting assembly comprises a frame that has an external perimeter surface free of apertures for mounting the frame to the jamb, an exterior surface facing the interior side of the window, and an interior surface in opposing relationship to the exterior surface; and a compressible seal extending outwardly from the external perimeter surface of the frame. The mounting assembly may also include a bracket. The bracket may be made of a polymer or metal composition. Preferably, the bracket is metal and designed such that it can be easily manufactured using a stamping process.

Figure 5:
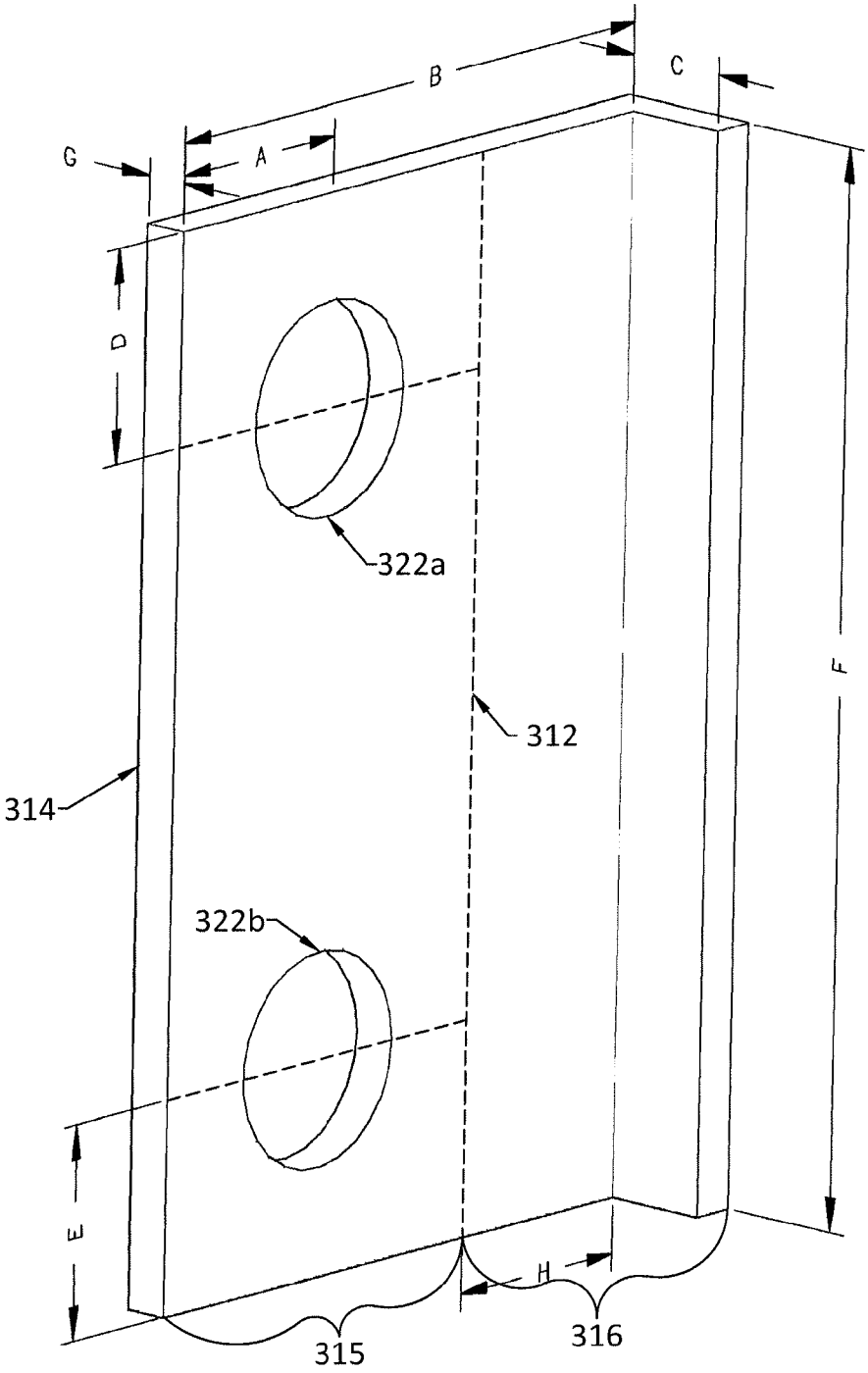
FIG. 5 is a top perspective view of a first mounting bracket for a mounting assembly according to another embodiment of the present invention.
Figure 6:
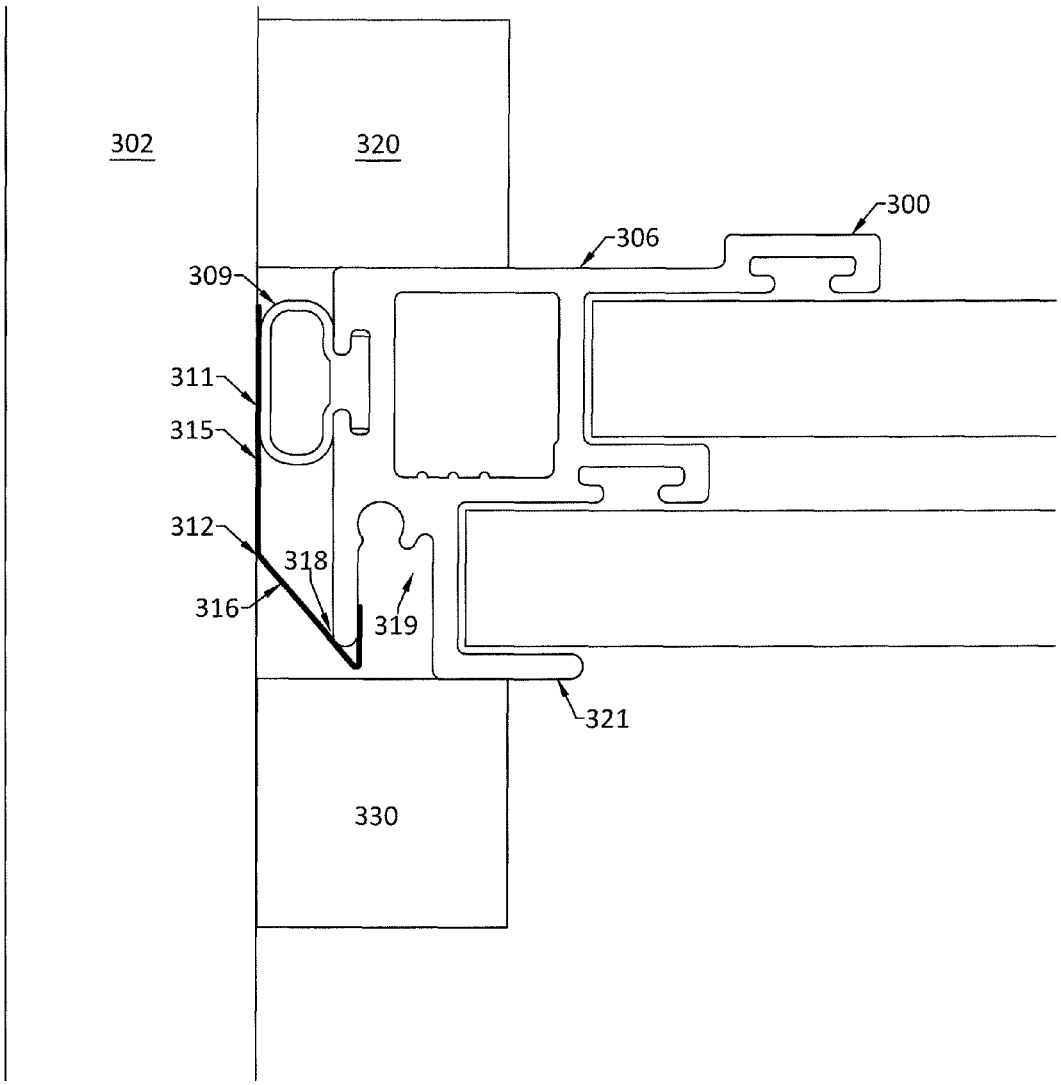
FIG. 6 is a cross-sectional view of a mounting assembly in an installed condition according to another embodiment of the present invention.

In one embodiment of the present invention illustrated in FIGS. 5 and 6, the bracket (314) may have a mounting portion (315) and a front portion (316) configured to engage an interior portion (318) of the frame (300). For example, as illustrated in FIG. 6, the front portion (316) of the bracket (314) may be deformable, so that when the frame (300) is mounted within a jamb (302) against a blind stop (320), the front portion (316) is bent to extend into a recessed portion (319) on the interior side of the frame (300) and then a trim stop (330) may be applied to the interior surface (321). By providing a recessed portion of the frame to which the front portion of the mounting bracket engages, the mounting bracket will not interfere with the ability of the trim stop to contact the interior surface of the frame. In the embodiment of FIG. 6, the mounting bracket should be fastened to the jamb prior to installing the frame. Any fastening means may be employed to attach the mounting bracket to the jamb, e.g. screws, nails, adhesive, etc. In the embodiment illustrated in FIG. 5, the mounting portion (315) of the bracket (314) includes fastener holes (322*a*, 322*b*) and may be bent along line (312). The dimensions (B, C, F-H) of the bracket and location of the fastener holes (A, D, E) are selected such that proper retention of the frame within the jamb is ensured. The distance (D and E) of the fastener holes from the edges of the bracket may be approximately equal.

Figure 7:
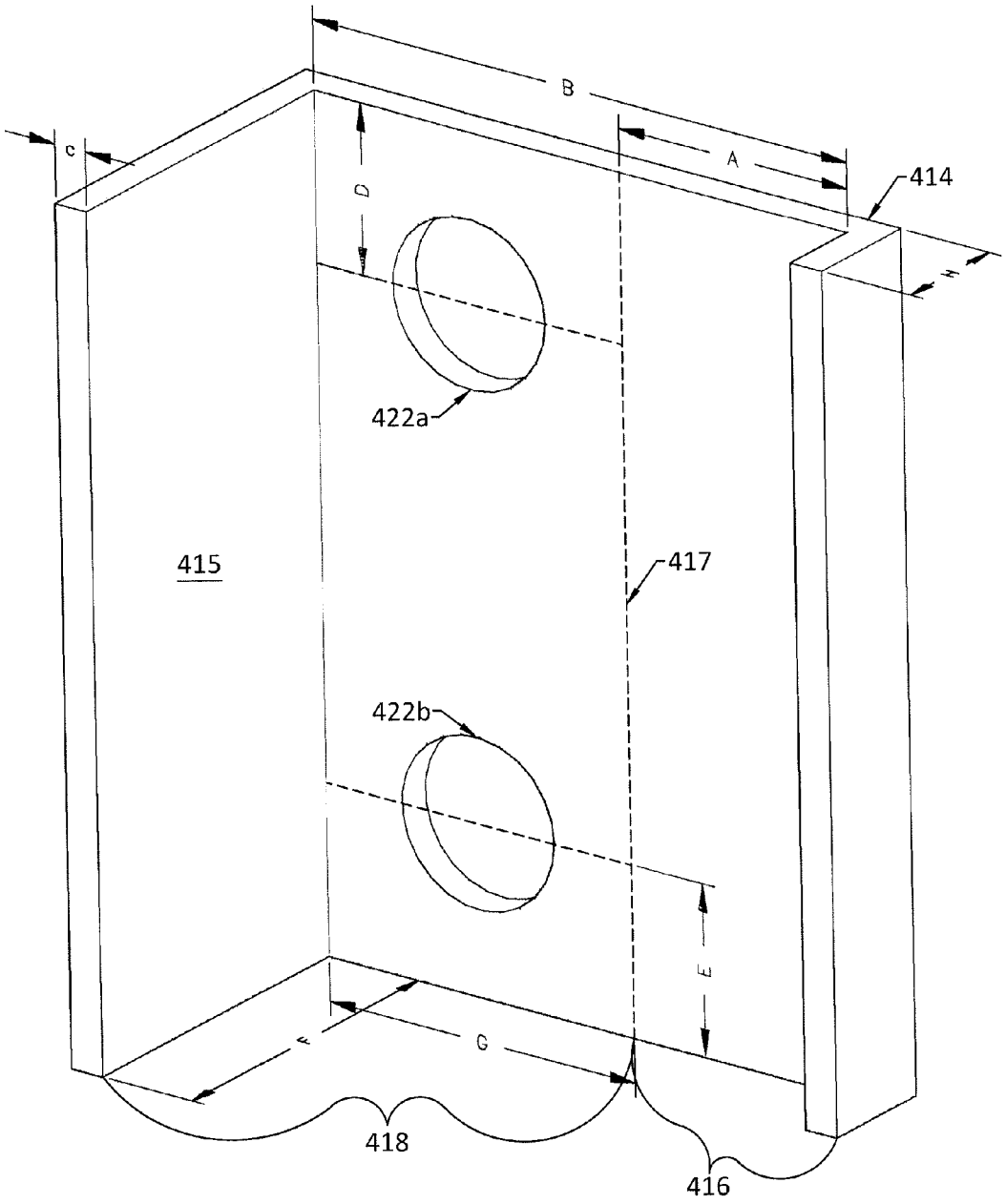
FIG. 7 is a top perspective view of a second mounting bracket for a mounting assembly according to another embodiment of the present invention.
Figure 8:
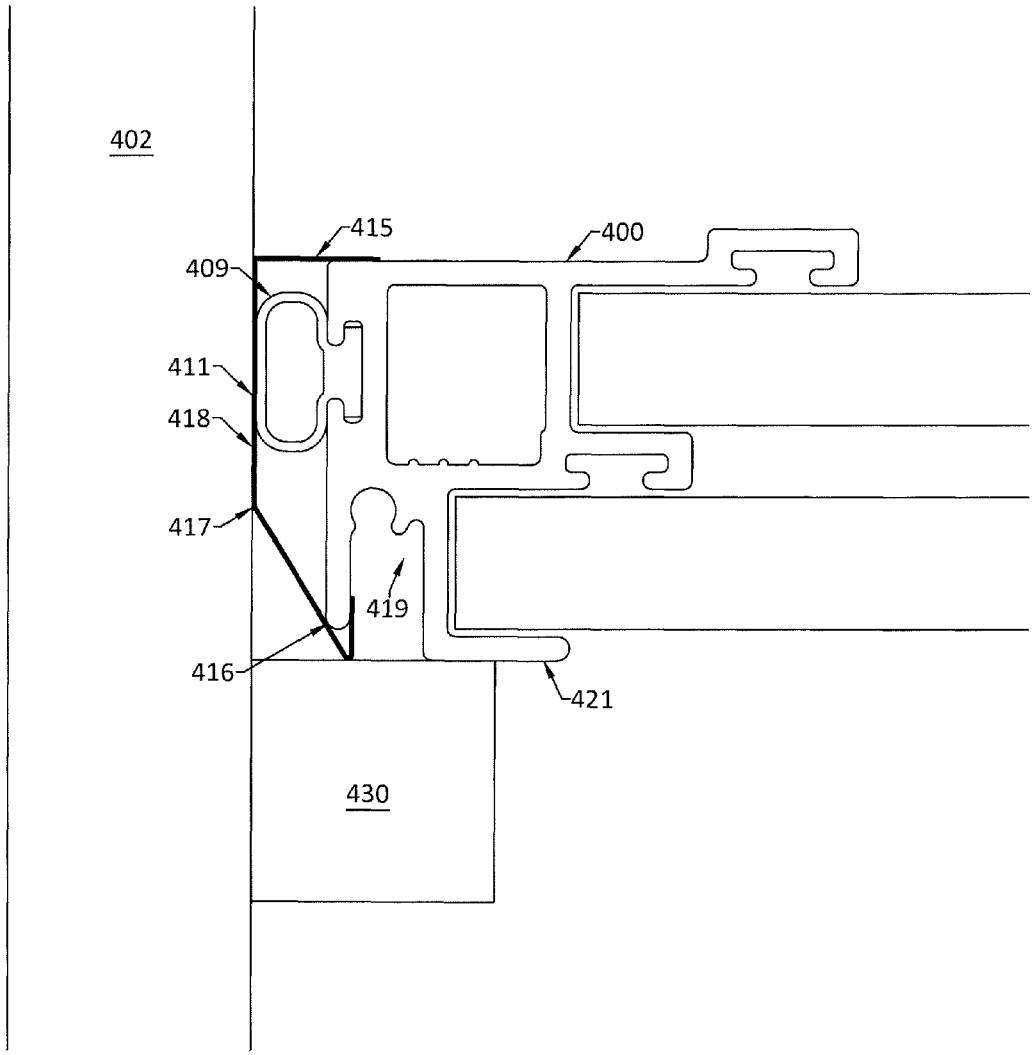
FIG. 8 is a cross-sectional view of a mounting assembly in an installed condition according to another embodiment of the present invention.

In an alternative embodiment of the present invention, the mounting bracket may also include a rear portion configured to engage the exterior surface of the frame. For example in the installed condition, as illustrated in FIGS. 7 and 8, the mounting bracket (414) may be bent along line (417), so that the front portion (416) is inserted into a groove (419), and a rear portion (418) which engages the frame (400) and limits movement of the frame within the jamb (402). In the embodiment of FIG. 8, a trim stop (430) is provided; however, a blind stop is unnecessary as the rear portion of the mounting bracket provides a bearing surface (415) for the frame. Similar to the embodiment of FIG. 5, the dimensions (A-C and F-H) of the bracket (414) and location of the fastener holes (D, E) are selected such that proper retention of the frame within the jamb is ensured. The distance (D and E) of the fastener holes from the edges of the bracket may be approximately equal.

In both of the embodiments illustrated in FIGS. 6 and 8, the frame bears a compressible seal against the jamb on the interior side of the primary window. For example, the compressible seal (309, 409) bears against the mounting portion (315, 418) of the bracket (314, 414) and the jamb (302, 402) above and below the bracket (314, 414), thus creating a seal (311, 411) to impede the transmission of air between the exterior surface (306) and the interior surface (321, 421) of the frame (300, 400).

A method of installing a mounting assembly for sealing a window made according to the present invention may comprise attaching a bracket to the jamb, the bracket having a mounting portion and at least one of a front portion configured to engage the interior surface of the frame and a rear portion configured to engage the exterior surface of the frame. If the mounting portion does not include a rear portion, a blind stop should also be attached to the jamb adjacent to the rear portion of the bracket. Optionally, an insulating material may be applied between the jamb and the bracket to provide a thermal break. The insulating material is preferably a self-adhesive polyisobutylene tape.

The method may further comprise inserting a frame within the jamb and adjacent to the bracket such that the frame bears a compressible seal against the jamb and the compressible seal impedes the flow of air between the exterior surface and the interior surface of the frame. In the event any gaps exist between the compressible seal and the existing jamb due to excessive warping of the jamb, a caulk rope may be applied to the area to enhance the intended function of the elastomeric seal.

Finally, the method may comprise engaging the front portion of the bracket with an interior surface of the frame or the rear portion of the bracket with an exterior surface of the frame to limit movement of the frame within the jamb, thus eliminating the need for apertures in the frame for mounting the frame to the jamb. The engaging step may include deforming the front portion of the bracket into contact with the interior surface of the frame. Preferably, the bracket is designed such that the front portion may be easily adjusted using a tool, such as a screwdriver.

Optionally, a trim stop may also be attached to the jamb to contact the interior surface of the frame. Upon attaching at least one of a blind stop and a trim stop, a barrier may be formed between the frame and at least one of the blind stop and the trim stop to impede the flow of air between the exterior surface and the interior surface of the frame.

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as falling within the spirit and scope of the invention.

What is claimed:

1. An installed insulating panel assembly for sealing a primary window having an interior side and an exterior side, the insulating panel assembly comprising:

a jamb;

a frame installed within the jamb on the interior side of a primary window panel, the frame having an external perimeter surface, an exterior surface facing the interior side of the primary window panel, and an interior surface in opposing relationship to the exterior surface;

a first glazing panel installed in and surrounded by the frame, a blind stop separate from the primary window panel configured to contact the exterior surface of the frame and a trim stop configured to contact the interior surface of the frame; and a compressible seal extending outwardly from the external perimeter surface of the frame, wherein the blind stop is fastened to the jamb at a location between the frame and the primary window panel and the exterior surface of the frame contacts the blind stop, and the trim stop is coupled to the jamb such that the frame is between the trim stop and the primary window panel and the interior surface of the frame contacts the trim stop;

the frame bears the compressible seal against the jamb on the interior side of the primary window panel forming a first barrier impeding the flow of air between the exterior surface and the interior surface of the frame, and the blind stop or the trim stop forms a second barrier impeding the flow of air, the first and second barriers together defining an air sealing chamber with the external perimeter surface of the frame and the jamb; and wherein when the insulating panel assembly is in a closed condition, a pocket of air is enclosed between the first glazing panel and the primary window panel over the entire area of the first glazing panel.

2. The insulating panel assembly of claim 1, wherein the trim stop includes an aesthetically-selected surface.

3. The insulating panel assembly of claim 1 further comprising a first track defined by an internal perimeter of the frame and the first glazing panel is mounted in the first track.

4. The insulating panel assembly of claim 3 further comprising a second track defined by the internal perimeter of the frame and a second glazing panel mounted within the second track, wherein the second glazing panel is operable and configured to move either horizontally or vertically relative to the first glazing panel.

5. The insulating panel assembly of claim 4 further comprising a low-emissivity coating applied to at least one of the first glazing panel and the second glazing panel.

6. The insulating panel assembly of claim 4, further comprising a solar control coating or film applied to at least one of the first glazing panel and the second glazing panel.

7. The insulating panel assembly of claim 3, wherein the frame includes at least one enclosed cavity between the internal perimeter and the external perimeter.

* * * * *